US010888763B2

(12) United States Patent
Gabriel, Jr.

(10) Patent No.: US 10,888,763 B2
(45) Date of Patent: Jan. 12, 2021

(54) CORNERMAN'S PORTABLE WORK STATION

(71) Applicant: Leonard Gabriel, Jr., Damascus, OR (US)

(72) Inventor: Leonard Gabriel, Jr., Damascus, OR (US)

( * ) Notice: Subject to any disclaimer, the term of this patent is extended or adjusted under 35 U.S.C. 154(b) by 0 days.

(21) Appl. No.: 16/522,338

(22) Filed: Jul. 25, 2019

(65) Prior Publication Data

US 2020/0238151 A1 Jul. 30, 2020

Related U.S. Application Data

(60) Provisional application No. 62/797,077, filed on Jan. 25, 2019.

(51) Int. Cl.

| | |
|---|---|
| ***A45F 4/02*** | (2006.01) |
| ***A47C 7/70*** | (2006.01) |
| ***A63B 71/14*** | (2006.01) |
| ***A63B 71/00*** | (2006.01) |
| ***A63B 69/00*** | (2006.01) |

(52) U.S. Cl.

CPC ..... *A63B 71/0036* (2013.01); *A45F 4/02* (2013.01); *A47C 7/705* (2018.08); *A63B 69/004* (2013.01); *A63B 71/14* (2013.01); *A63B 2244/102* (2013.01)

(58) Field of Classification Search

CPC ... A63B 71/0036; A63B 69/004; A63B 71/14; A63B 2244/102; A45F 4/02; A47C 7/705; A47B 23/002; A47G 23/0608; B60N 3/002; B60N 3/001

See application file for complete search history.

(56) References Cited

U.S. PATENT DOCUMENTS 297,219 A * 4/1884 Anthony ..... A47B 23/002 108/43
3,879,775 A * 4/1975 Iwata ..... A47G 9/1045 5/639
4,635,110 A * 1/1987 Weinblatt ..... B60R 11/0211 206/335
4,815,623 A * 3/1989 Levin ..... A47G 23/0608 220/17.1
4,993,785 A * 2/1991 Dunand ..... B42D 5/005 248/224.61
5,005,702 A * 4/1991 Davis ..... A47B 23/002 108/43
5,081,936 A * 1/1992 Drieling ..... B60N 3/002 108/25
5,265,292 A * 11/1993 Underell ..... A47C 4/52 297/380
5,355,811 A * 10/1994 Brewer ..... A47B 21/0314 108/43

(Continued)

*Primary Examiner* — Hanh V Tran
(74) *Attorney, Agent, or Firm* — Mark S Hubert

(57) ABSTRACT

A portable hand wrapping station for a fighter's trainer/cornerman that is able to transport all the necessary accessories and can quickly be set up on a folding chair's back top edge. It is a three panel rollup or foldup design that may be secured to form a central pocket that can be slid over a chair back, so that an inner pellet-filled securement means will rest and conform to the chair back's top edge, therein securing the adjacent wrist pad. Its front and back panels may form a roll or may form a valise.

8 Claims, 9 Drawing Sheets

(56) References Cited

U.S. PATENT DOCUMENTS 5,611,098 A * 3/1997 Skibik ..... A42B 1/006 108/43
5,765,790 A * 6/1998 Kuldvere ..... A47B 23/002 108/43
5,893,540 A * 4/1999 Scott ..... A47B 23/001 108/43
5,937,765 A * 8/1999 Stirling ..... A47B 23/002 108/43
5,979,337 A * 11/1999 Clark ..... A47B 23/06 108/23
6,003,446 A * 12/1999 Leibowitz ..... A47B 23/002 108/43
6,041,715 A * 3/2000 Jarke ..... A47B 23/002 108/43
6,050,200 A * 4/2000 Sullins ..... A47B 23/002 108/25
6,116,165 A * 9/2000 Kadesky ..... A47B 23/002 108/161
6,145,661 A * 11/2000 Jung ..... A45C 13/02 190/102
6,269,948 B1 * 8/2001 Jackson ..... A45C 7/0095 108/43
6,496,360 B1 * 12/2002 Cordes ..... A47B 23/002 108/43
6,685,016 B2 * 2/2004 Swaim ..... A45C 7/0095 206/320
6,986,308 B1 * 1/2006 King ..... A47G 23/0608 108/25
7,415,932 B1 * 8/2008 Ngo ..... A47B 23/001 108/115
8,850,645 B1 * 10/2014 Jackson ..... A47C 7/021 297/452.23
8,863,672 B1 * 10/2014 Silknitter ..... A47G 23/0608 108/38
9,265,330 B1 * 2/2016 Golin ..... A45C 9/00
9,999,298 B1 * 6/2018 Sullins ..... A47B 23/06
2003/0019402 A1 * 1/2003 Cogliandro ..... G06F 1/1632 108/50.11
2004/0112931 A1 * 6/2004 Swaim ..... A45C 7/0095 224/585
2005/0110309 A1 * 5/2005 Cziraky ..... A63H 3/003 297/181
2006/0165318 A1 * 7/2006 Gotesson ..... A45F 4/02 383/106
2006/0169691 A1 * 8/2006 Rothschild ..... A45C 13/1038 220/7
2007/0007422 A1 * 1/2007 Rha ..... A47B 23/042 248/447.1
2007/0084891 A1 * 4/2007 Gillespie ..... A45F 4/02 224/155
2007/0152005 A1 * 7/2007 Bui ..... A45C 9/00 224/577
2009/0114690 A1 * 5/2009 Landay ..... A45F 3/04 224/575
2010/0205747 A1 * 8/2010 Iskowitz ..... B60N 3/004 5/655
2010/0236452 A1 * 9/2010 Ruddy ..... B43L 3/008 108/6
2012/0237141 A1 * 9/2012 Muir ..... A63B 71/0036 383/4
2013/0255000 A1 * 10/2013 Kavovit ..... A47G 9/10 5/639
2014/0008401 A1 * 1/2014 Scott ..... A45F 4/02 224/155
2014/0251866 A1 * 9/2014 Smallman ..... B65D 1/34 206/557
2014/0371007 A1 * 12/2014 Marciano ..... A63B 71/12 473/446
2015/0076182 A1 * 3/2015 Coleman ..... A45F 3/04 224/155
2016/0263423 A1 * 9/2016 Ivy ..... B32B 3/10
2017/0251779 A1 * 9/2017 Lai ..... A45C 1/02
2018/0043809 A1 * 2/2018 Probst ..... B60N 3/002
2018/0235352 A1 * 8/2018 Jones ..... A45F 4/12
2018/0272180 A1 * 9/2018 Abrahams ..... A63B 23/0458
2018/0303226 A1 * 10/2018 Weaver, Jr. ..... F41H 5/08

* cited by examiner

CORNERMAN'S PORTABLE WORK STATION

PRIORITY

This patent application claims domestic priority from and incorporates in its entirety by reference, U.S. Provisional Patent Application Ser. 62/797,077 entitled "Cornerman's Bag" filed Jan. 25, 2019.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to sports bags, and more particularly to specialized portable work stations for the trainers of pugilistic competitors.

BACKGROUND

Pugilistic competitors whether boxers, mixed martial artists, kickboxers or the like, attend their events with a plethora of accessories. Such accessories include focus mitts, hand wraps, tape, scissors, gauze and medical supplies to list a few. This equipment is necessary to prepare the fighter and wrap their hands before matches. In lesser venue settings there is scant little in the fighter's dressing room but chairs and lockers. This lack of furniture makes it hard for the trainer to find a suitable surface to wrap the fighter's hands. It also makes it hard to spread out all of the accessories for use.

Thus, a specialized sports roll/bag to provide a surface for taping hands and/or store and organize all the common cornerman accessories would be a welcome product in the pugilistic world. The following apparatus provides a novel design and solution to aforementioned problems.

BRIEF SUMMARY

In accordance with various embodiments, a cornerman's hand wrapping support bag with or without the attached pockets that can hold numerous accessories in an organized fashion and can morph to create a wrist support about a chair is provided.

In its most simplistic form, a hand wrapping pad, attachable to a chair so as to firmly reside along the top edge of the chair's back.

In one aspect, a hand wrapping station of a hand wrapping pad affixed to a sports bag or roll.

In another aspect, a sports bag or roll with a C shaped top closure flap adapted for attachment about the top of a chair so as to allow the remainder of the bag to hang suspended with its contents available below the top closure flap.

In yet another aspect, a cornerman's work station with a wrist support adapted to be temporarily anchored along the top edge of a chair is provided.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components. In some instances, a sub-label is associated with a reference numeral to denote one of multiple similar components. When reference is made to a reference numeral without specification to an existing sub-label, it is intended to refer to all such multiple similar components.

DETAILED DESCRIPTION OF CERTAIN EMBODIMENTS

Figure 1:
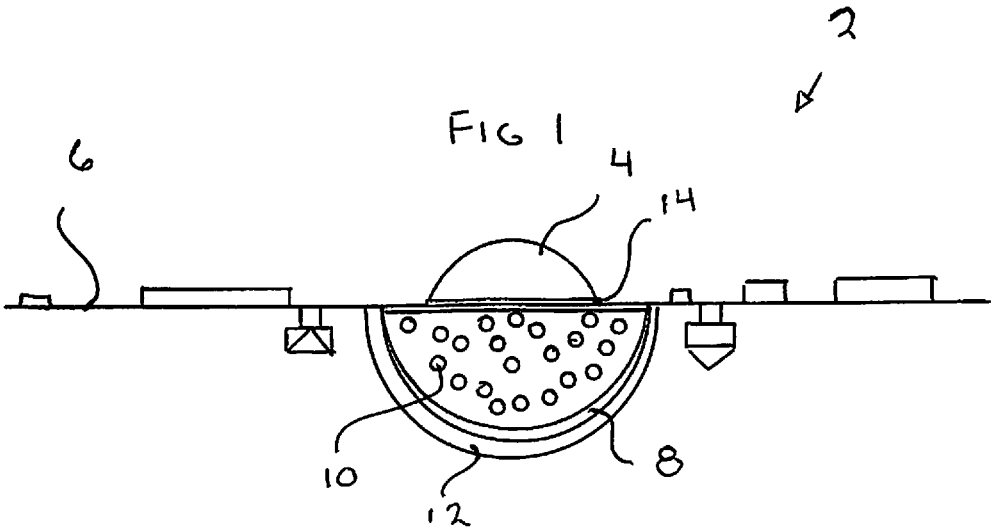
FIG. 1 is a cross sectional view of the cornerman's work station.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. It should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

The present invention relates to a novel design for work station for a boxer's trainer/cornerman. It provides a portable work station that a trainer can strap over the top edge of the back of a chair to present a padded wrist support integrated with storage compartments for the associated hand wrapping materials. It is designed to function as both a hand wrap station and a valise/roll to carry the necessary supplies, accessories and paperwork that a cornerman/trainer brings to the fight. It is space efficient and enables the accessible organization of fighting accessories and the erection of a work station for wrapping a fighter's hands. The configuration and extent of the storage compartments dictate the style of bag or roll the cornerman's work station takes.

Looking at FIGS. 1-4 it can be seen that the cornerman's work station 2 is a three-panel assembly with a non-padded front panel 16 (facing the cornerman) a padded center panel 18 (residing on the top edge of a chair) and a non-padded back panel 20 (facing the fighter). Each panel is rectangular having a front edge a back edge and two side edges. The center panel is disposed between a front panel and a back panel. There are several ways of conjoining the three panels such that the back edge of the front panel is connected to or contiguous with the front edge of the center panel, and the front edge of the back panel is connected to or is contiguous with the back edge of the center panel. The work station 2 is foldable or rollable, wherein the front panel 16 may be folded (or rolled) so that its top face resides adjacent the top face of the center panel 18 and then the back panel folded (or rolled) so that its top face resides adjacent the bottom face of the front panel. In this storage configuration, the securement means 22 on the front and back panels 16/20 are engaged to hold the work station 2 in its closed configuration. It is well known that the securement means 22 may be magnets, hook and loop fasteners, dome fasteners, engageable snaps, ties or the equivalent. It is envisioned that the securement means may alternately be located along or adjacent the bottom edge of the front and back panels to allow for the rolled storage of the work station 2. There are also pairs of chair locks 28 on either side of the front and back panels of the station. These chair locks 28 are connectable members, (preferably on adjustable straps) that connect the sides of the front panel and the sides of the back panel together to form the central region of the work station 2 into an open-ended pocket to envelop part of the top of the chairback. There is a multitude of mechanical locking devices that may be used as chair locks, such as ties, belted clips, straps, buttons, hook and loop ties, strapped hooks and the like, however the preferred embodiment is a length adjustable, connectable, belt/strap clasp.

In the simplest embodiment, the cornerman's work station 2 has a wrist pad 4 centrally affixed to a fabric sheet 6 constituting the top of the center panel 18. In the preferred embodiment the wrist pad 4 is a linear, closed cell polymer foam pad having a generally semi-circular or elliptical cross section, however any elastically deformable polymer pad would be an equivalent. The pad 4 may be attached to the fabric sheet 6 in a plethora of different ways as discussed herein. Generally, it will be adhesively affixed to a polymer plate 14 that is stitched or otherwise mechanically affixed or bonded (i.e. glued, hook and loop fasteners strips, dome fasteners, magnets, clips, etc.) to the top face of the fabric sheet 6. This wrist pad 4 has a linear axis that is aligned with the linear axis of the center panel.

On the bottom side of the central panel 18, located below the pad 4, is a pad securement means 22 to hold the pad 4 with its liner axis aligned with the linear axis of the top of the edge of a chair's back. The long sides edges of this pad securement means 22 form the interface between the center panel 18 and the front panel 16 and rear panel 20. The linear axis of the pad securement means is aligned with the linear axis of the center panel and with the linear axis of the wrist pad. The linear axes of the pad securement means 22 and the wrist pad 4 are coplanar and parallel. The preferred embodiment of the pad securement means 22 is a sealed linear sleeve 8 filled with an array of shiftable pellets 10 that is constrained in a linear pocket 12 formed along the width of the fabric sheet 6. (Shiftable meaning that while the pellets are frictionally constrained as a mass within the linear sleeve, there is enough freedom of movement between the pellets to allow the overall linear sleeve to conform its shape to that of physical objects that it rests upon.) Generally, these pellets are small and lie in the range of 3 to 5 mm. The pellets 10 need not be spherical. These pellets 10 may be polymer spheres, beads, beans, peas, sand, rice and the like. The use of heavier pellets, such as sand or rice, aids in maintaining of the pad securement means firmly to the chair. With heavier pellets 10 an appreciable mass will hang over each side of the top edge of the chair's back, stabilizing the pad 4 along the chair's top edge.

The linear sleeve 8 of the pad securement means is preferably made of fabric and fits into a linear pocket 12 formed centrally on or in the fabric sheet 6. Generally, each of the linear pocket's ends will be sealed or sealable to ensure the linear sleeve does to shift side to side and that any perforation in the linear sleeve 8 will not spill its pellets. It is to be noted that although depicted with a linear sleeve to constrain the pellets, this may be eliminated and the pellets feed directly into the linear pocket 12.

On the front panel 16 is a polymer strip 24 upon which the cornerman may hang pre-cut pieces of tape. There are also various sized and shaped pockets 26 affixed to hold accessories such as tape, scissors, wrap etc. Some of these pockets may be sealable with zippers and the like, while others may be open. The pockets may be of fabric or may be of a clear polymer. Generally, there will be a minimum of two pockets on the front panel 16. The back panel 20 will also have at least one pocket for the fighter to place his phone so he can listen to music while his hands are being wrapped.

There are numerous ways that the three-panel design may be fabricated, each of which will work equally as well. Two of these various methods of construction may be explained in conjunction with viewing FIGS. 5 and 6.

Although the cornerman's work station is described as having three panels which are the equivalent to three zones or areas if on a single fabric sheet, these not be made of one contiguous fabric sheet. The construction may be of two or three panels joined together as would be well known by one skilled in the art. In the first embodiment construction of FIG. 5 it can be understood that the three panels are different regions on a single fabric sheet 6. Here the pad 4 is secured with an adhesive 30 to a polymer plate 14 that is stitched or otherwise mechanically affixed or bonded (i.e. glued, hook and loop fasteners strips, dome fasteners, magnets, clips, etc.) to the central area of the top face of the fabric sheet 6. The linear pocket 12 containing the linear sleeve 8 housing the pellets 10 may be stitched along its top two edges 32 to the bottom face of the fabric sheet 6. Again, the dividing lines for the three panel are the where the two edges of the linear pocket 12 are connected to the fabric sheet 6.

Figure 5:
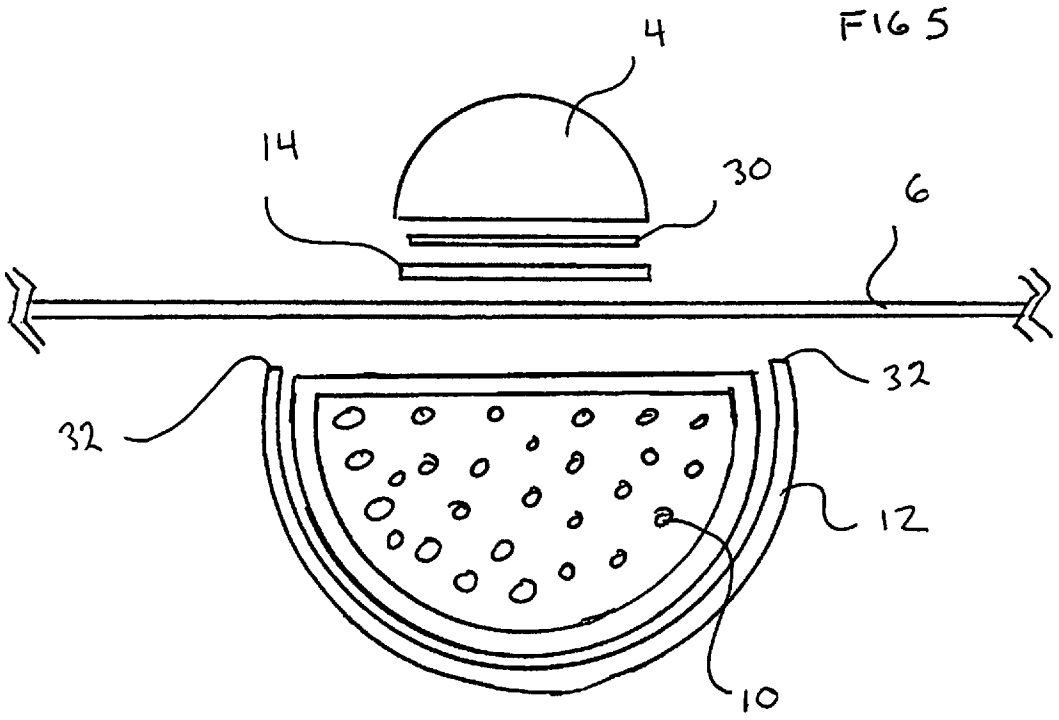
FIG. 5 is an exploded side view of the cornerman's bag with a first embodiment assembly.
Figure 6:
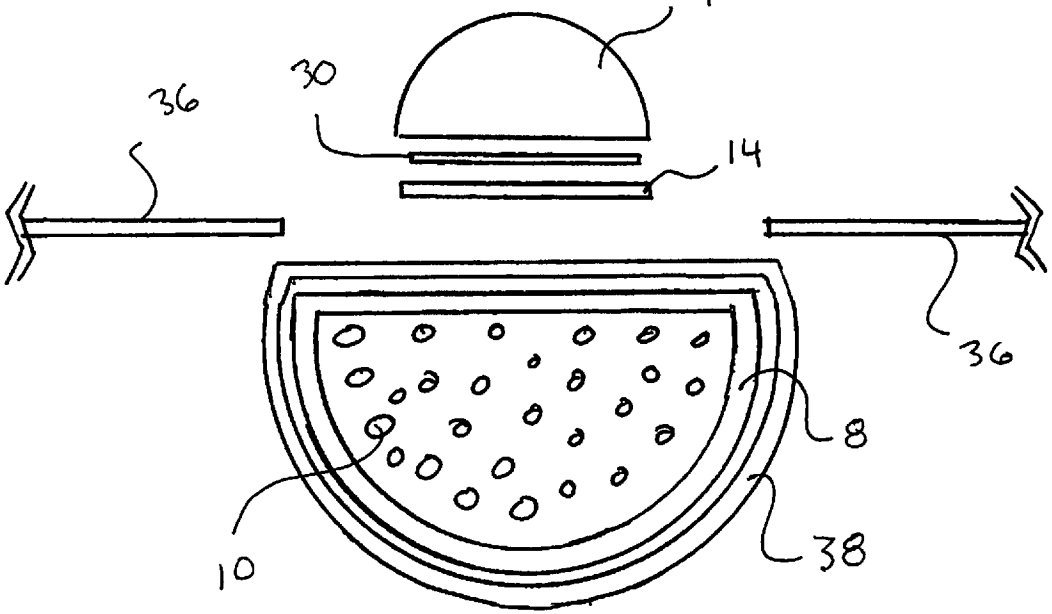
FIG. 6 is an exploded side view of the cornerman's bag with a second embodiment assembly.

In an alternate embodiment construction, the center panel 18 of the cornerman's work station 2 is a separate body stitched along its sides to front and back pieces of fabric 36. Here, the linear pocket is formed as a linear tube 38 containing the linear sleeve 8, which houses the pellets 10. Onto the linear tube 38, the pad 4 is secured with an adhesive 30 to a polymer plate 14 that is stitched or otherwise mechanically affixed or bonded to the top of the linear tube 38. Along the length of the side of the linear tube 38 the two pieces of fabric 36 (comprising the front and back panels) may be stitched. Thus, as illustrated in FIGS. 5 and 6, the linear pocket may be formed on the linear sheet 6 or it may be a separate pocket, attachable as a tube across two pieces of fabric 36. Hook and look fasteners, dome fasteners, buttons, straps are only a few of the plethora of alternate methods through which the linear tube 38 may be attached to the two fabric sheets.

The wrist pad 4 may also be attached to the fabric sheet 6 in a plethora of ways. Preferably, a polymer plate may be affixed to a top face of the sheet 6 by gluing stitching or any of a host of mechanical fastening means. The bottom planar face 10 of the wrist pad 4 may then be attached to the polymer plate by mechanical or chemical means. Alternatively, the polymer closed cell foam wrist pad 4 may have its bottom face heat sealed or melted into a solid planar face eliminating the need for a separate plate and adhesive. In such a fabrication there may be a host of different means for attaching the wrist pad 4 to the fabric sheet 6 (including imbedded fasteners) as is well known in the industry.

The fabric sheet 6 may be a contiguous sheet with an upper linear pocket, and or a lower linear pocket sewn to, or it may be two smaller sheets attached to the sides of a single or double linear pocket sleeve.

In use, the cornerman's work station is opened by releasing the securement means 22. Then the pairs of chair locks 28 are engaged to form an open-ended pocket under the bottom side of the station 2, in the central region of the work station 2 between the front panel, the center panel and the back panel. The pocket formed is slid over the top of a chairback so the top edge of the chair resides directly under the linear sleeve 8 filled with the array of shiftable pellets 10 of the pad securement means 22. The wrist pad 4 is then tapped to seat the chairback's top edge into the array of pellets. This array of beads will then shift around in the sleeve to conform to the top edge of the chair and will then hold the pad 4 with its liner axis aligned with the linear axis of the top of the edge of a chair's back. The fighter will sit facing the back panel 20 with his wrists resting palms up on the pad 4 and his phone in the pocket 26, and the cornerman will sit facing the front panel 16, where he has access to his tools and supplies. The cornerman may now wrap the fighter's wrists while the fighter listens to music through earphones from a portable media device he places in the pocket on the back panel 20.

There are more extensive embodiments of this cornerman's work station that utilize the cornerstone pad 4 and pad securement means 22, but that have more complexity to the front and back panels so as to form a valise. In this valise embodiment 40 the back panel is a zippered rear pouch panel 42 and the front panel is an open pocket front valise panel 44.

All embodiments have a three-panel design of contiguous front, center and back panels whether made of separate mechanically joined panels or of a continuous piece of fabric. The center panel has a top face with a linear, elastically compressible/deformable pad, directly or indirectly affixed thereon and a bottom face with a pad securement means directly or indirectly affixed thereon. The retention of the shifttable pellets within the pad securement means may or may not utilize an interior sleeve. The front and rear panels are removably connectable by a fastening means such as connectable, adjustable straps, clips, buttons, ties, elastic cords or the equivalent.

Figure 2:
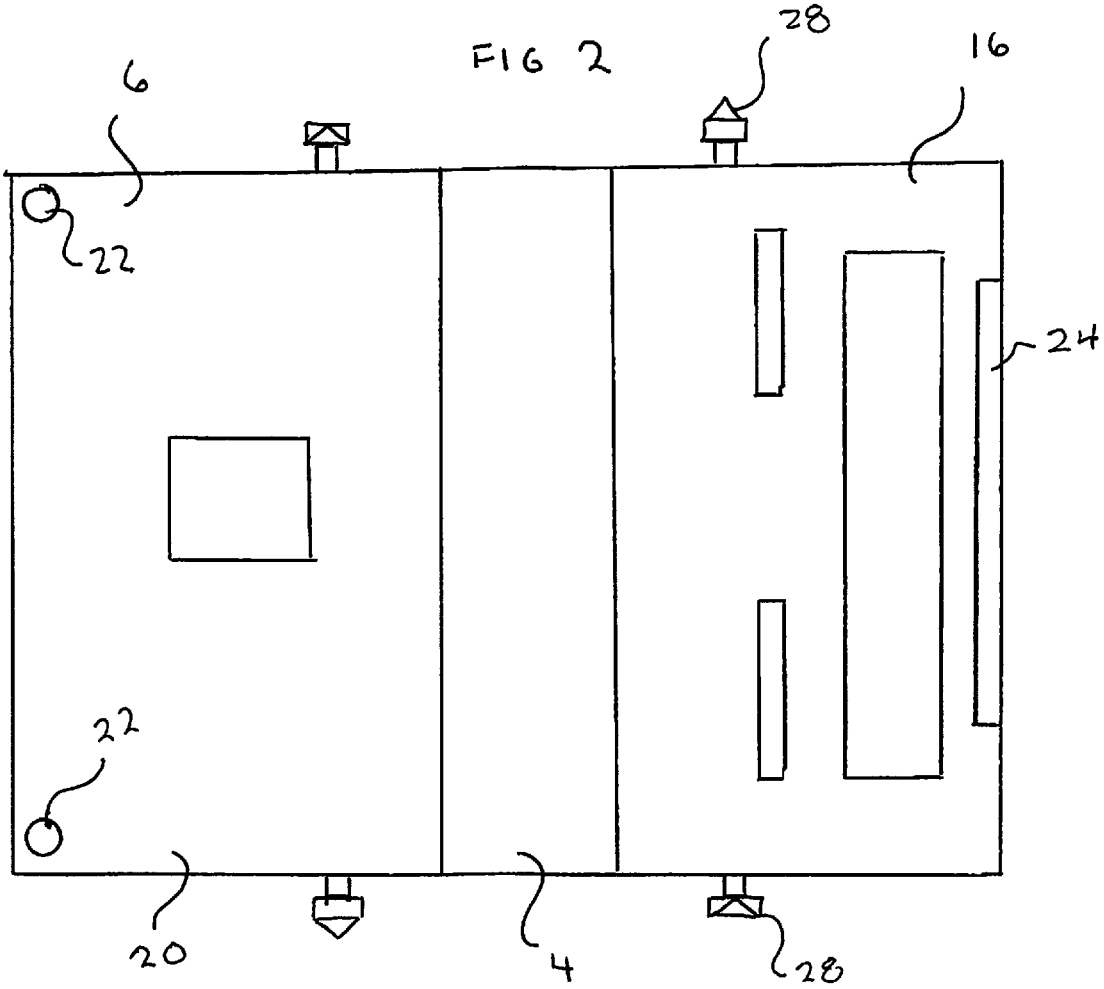
FIG. 2 is a top view of the cornerman's work station.
Figure 3:
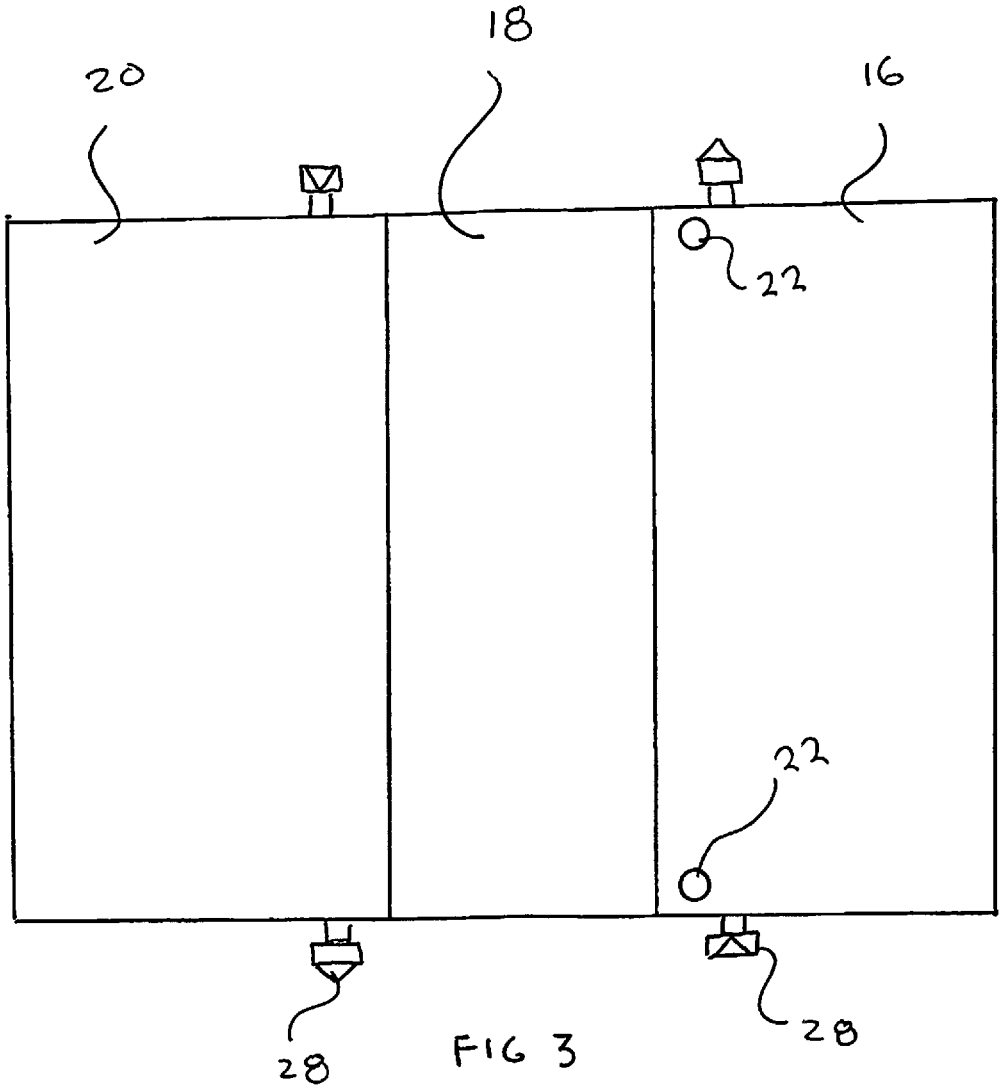
FIG. 3 is a bottom view of the cornerman's work station.
Figure 4:
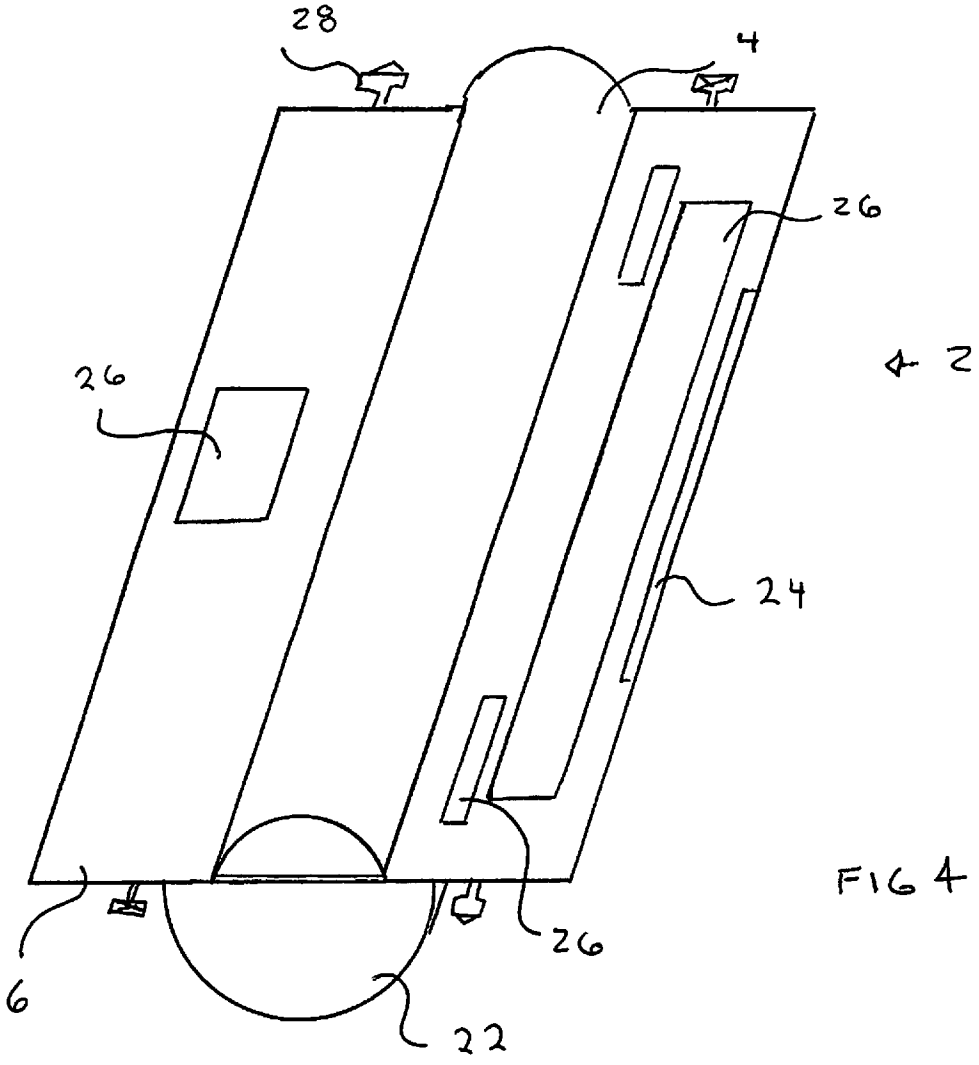
FIG. 4 is a side perspective of the cornerman's work station.
Figure 7:
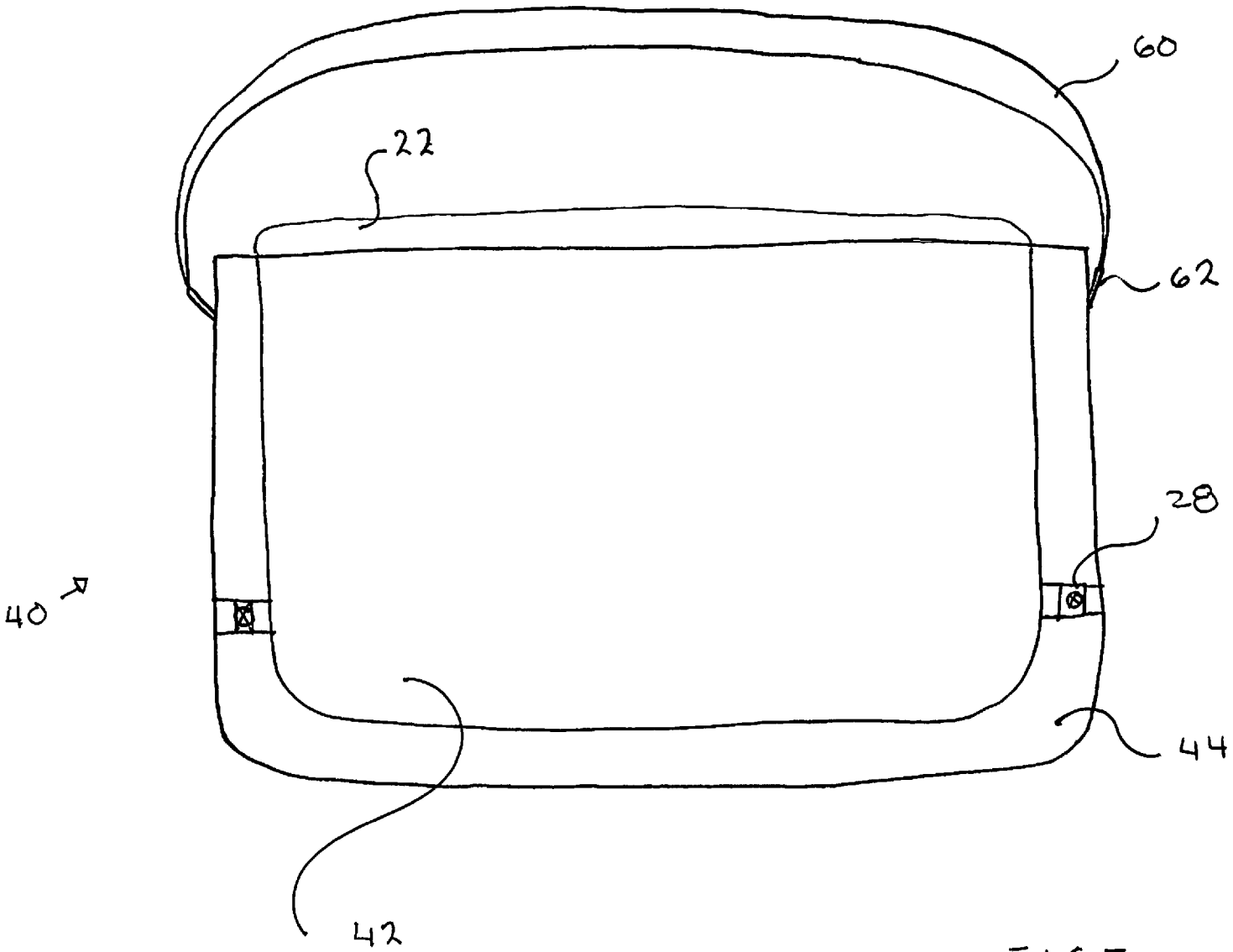
FIG. 7 is a front view of a closed cornerman's work station with shoulder strap, in the valise embodiment.
Figure 8:
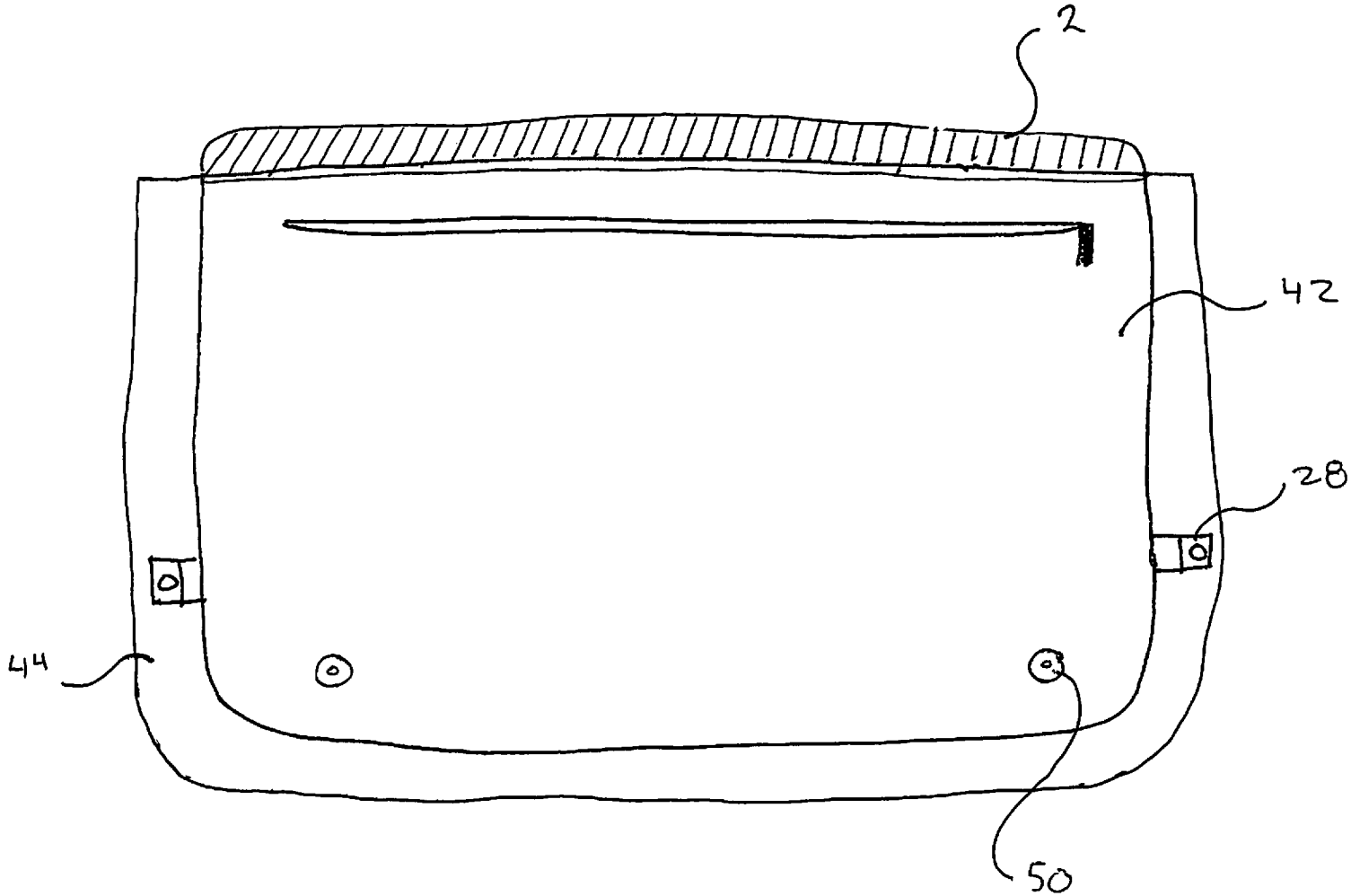
FIG. 8 is a rear view of an open cornerman's work station with shoulder strap removed, in the valise embodiment.
Figure 9:
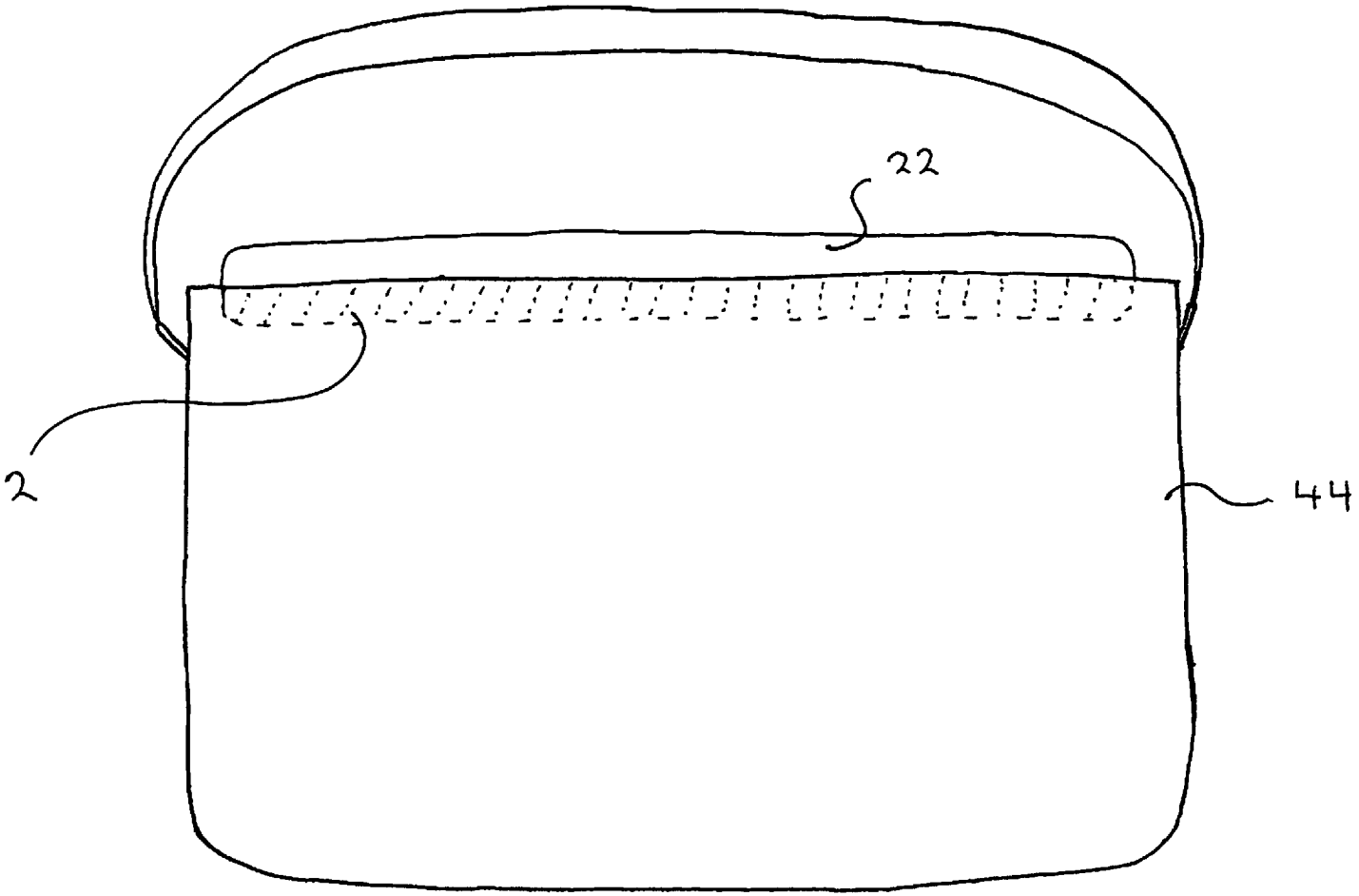
FIG. 9 is a rear view of a closed cornerman's work station with the wrist pad shown in phantom view.
Figure 10:
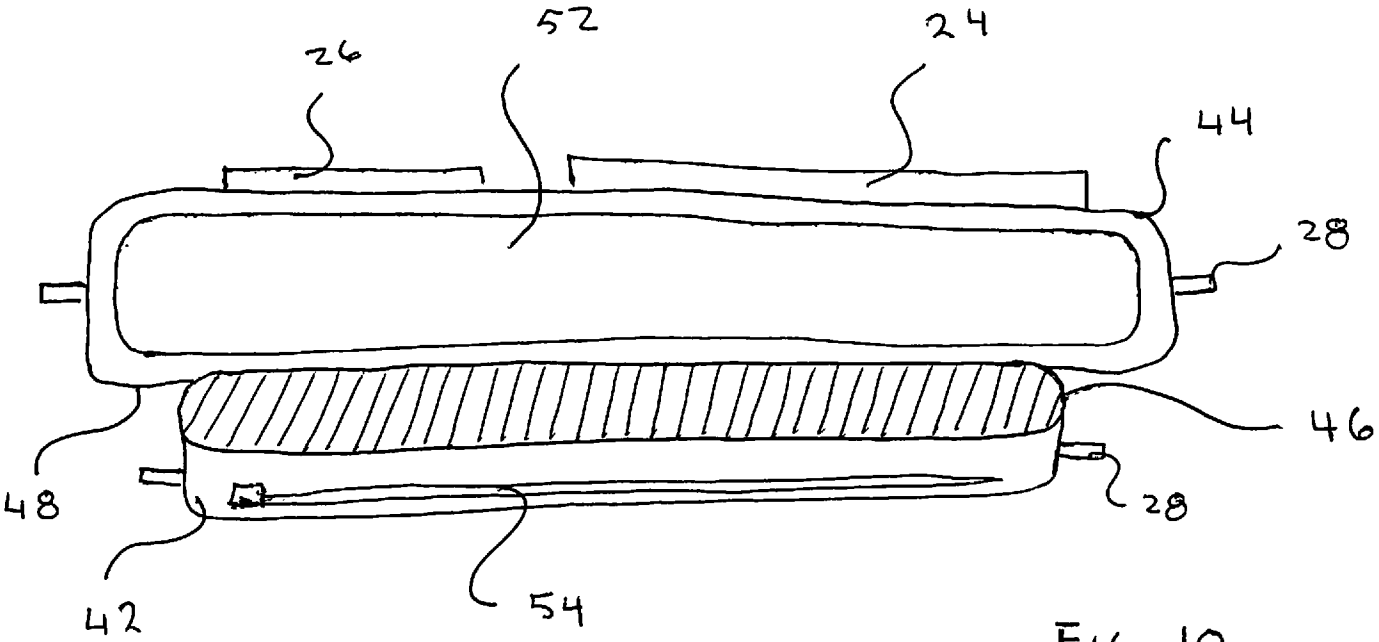
FIG. 10 is a top view of an open cornerman's work station in the valise embodiment as it would appear on a chair with its chair locks not fastened.

Looking at FIG. 7, it can be seen that the zippered rear pouch panel 42 and front valise panel 44 are separated by the central panel 46 which consists of the wrist pad 2 (FIGS. 8 and 10) and the pad securement means 22. In this embodiment's closed configuration, the pad securement means 22 faces upward and is exposed. As can be seen in FIG.2 the central panel 46 resides centered between the front panel 16 and the rear panel 20 so as to be centered within the cornerman's work station 2.

To open and install, the rear pouch panel 42 detaches from its magnetic engagement with magnet sets 50 on the front face of the front valise panel and flips over the back edge 48 of the front valise panel 44, separated by the central panel 46. (FIG. 10) This exposes the pockets 26 and the polymer strip 24 on the front of the front valise panel. When the rear pouch panel 42 is in this position, the wrist pad 2 faces upward and the pad securement means 22 faces downward. This allows the pair of length adjustable chair locks 28 to be connected to again form an open pocket that can be installed over the top edge of the back of a folding chair. All of the structure of the wrist pad 2 and the pad securement means 22 remain similar to that described in the preferred embodiment 2.

The primary difference between these embodiments is that the front and rear panels have been designed to incorporate pockets for papers, and for holding more supplies and equipment such a focus mitt. Looking at FIG. 10, the extra pouch pocket 52 of the front panel and the zippered paper pouch 54 of the rear panel can best be seen.

Generally, this embodiment is a flexible, generally planar valise style bag made preferably of a thick fabric such as a canvas or duck cloth style, fabricated in a natural or polymer fiber. For longevity and aesthetics, a wear band (not illustrated) may horizontally encircle the bottom of the front valise panel 44. An optional strap 60 with or without padding and shoulder grips is removably affixed via a set of adjustable clip-lock straps 62. The strap 60 adjusts to set the hang height of the valise 40 off the shoulders.

Of function importance, the center panel 46 is constructed the same in both embodiments and cross sectionally will be structurally indistinguishable. Each of the methods of construction/connection disclosed for the front, center and back panels of the preferred embodiment are applicable to the valise embodiment.

Although not seen in the FIGS, the front valise panel 44 may have expandable sides to enhance the thickness and capacity of the valise 40. These are sides that have vertical pleats therein so as to open in an according style format. A set of engageable clips similar to those used to retain the front flap 26 are envisioned for the compression of the valise's width.

While certain features and aspects have been described with respect to exemplary embodiments, one skilled in the art will recognize that numerous modifications are possible. While certain functionality is ascribed to certain system components, unless the context dictates otherwise, this functionality can be distributed among various other system components in accordance with the several embodiments.

Hence, while various embodiments are described with—or without—certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover any structural permutation based on the disclosed elements.

Having thus described the invention, what is claimed as new and desired to be secured by Letters Patent is as follows:

1. A portable hand wrapping station comprising:

a non-padded front panel;

a non-padded back panel;

a center panel having a top face and a bottom face, said center panel disposed centrally between said front panel and said back panel;

a compressible, elastically deformable linear pad affixed only to a top face of said center panel; and a pad securement means affixed to a bottom face of said center panel, beneath said linear pad, said linear pad centered on said portable hand wrapping station, wherein said pad securement means comprises a single linear pocket residing directly below said linear pad, centered on said portable wrapping station; and an array of pellets within said linear pocket, said pellets shiftable with respect to adjacent pellets.

2. The portable hand wrapping station of claim 1 wherein said pad securement means further comprises a linear sleeve within said linear pocket; wherein said array of pellets resides within said linear sleeve.

3. The portable hand wrapping station of claim 1 wherein said front panel has a linear polymer strip affixed to a front side.

4. The portable hand wrapping station of claim 1 wherein said front panel has a linear polymer strip affixed to a front side.

5. The portable hand wrapping station of claim 3 further comprising:

at least one pocket on said front panel.

6. The portable hand wrapping station of claim 1 wherein said linear pad has a first linear axis and said pad securement means has a second linear axis, and wherein said first linear axis and said second linear axis are co planar and parallel.

7. The portable hand wrapping station of claim 6 further comprising:

at least two pair of connectable chair locks affixed to said front panel and said back panel.

8. The portable hand wrapping station of claim 7 wherein said at least two pair of chair locks comprising:

a first pair of straps affixed on the front panel; and a second pair of straps affixed on the back panel; wherein said first pair of straps are connectable to said second pair of straps to form an open pocket between said front panel, said center panel and said back panel.

* * * * *